US005924568A

United States Patent [19]

Zajonc

[11] Patent Number: 5,924,568

[45] Date of Patent: Jul. 20, 1999

[54] REMOVABLE BUCKET INSERT FOR CONTAINING TOOLS

[76] Inventor: Adam E. Zajonc, 1608 NW. 43rd St., Lawton, Okla. 73505

[21] Appl. No.: 09/048,665

[22] Filed: Mar. 26, 1998

[51] Int. Cl.[6] ..... B65D 85/20

[52] U.S. Cl. ..... 206/373; 206/372; 220/735

[58] Field of Search ..... 206/372, 373, 206/804; 220/23.83, 528, 735, 527, 532, 771, 756

[56] References Cited

U.S. PATENT DOCUMENTS

| | | | |
|---|---|---|---|
| 3,751,845 | 8/1973 | Van Leeuwen . | |
| 5,011,013 | 4/1991 | Meisner et al. | 206/373 |
| 5,186,329 | 2/1993 | Fogelberg | 206/373 |
| 5,271,520 | 12/1993 | McAfee | 206/373 |
| 5,337,892 | 8/1994 | Zaffina | 206/315.11 |
| 5,350,065 | 9/1994 | Darrey | 206/373 |
| 5,370,263 | 12/1994 | Brown | 206/373 |
| 5,386,922 | 2/1995 | Jordan | 206/373 |
| 5,392,901 | 2/1995 | Kuray et al. | 206/372 |
| 5,439,108 | 8/1995 | Lackie | 206/373 |
| 5,441,163 | 8/1995 | Carrasco | 220/23.86 |
| 5,540,329 | 7/1996 | Vogeley | 206/373 |
| 5,669,498 | 9/1997 | Fierek et al. | 206/373 |

*Primary Examiner*—David T. Fidei

[57] ABSTRACT

A tool container insert for a bucket is provided which is removably situated within the bucket and further includes a handle for facilitating the removal thereof. The tool container insert further includes a pair of upstanding plates connecting a top plate and a bottom plate of the tool container insert. The upstanding plates has a generally V-shaped vertical cross-section and converge from top to bottom. The top plate and the bottom plate have a periphery of a similar shape and size substantially equal to a bottom of the bucket.

10 Claims, 2 Drawing Sheets

REMOVABLE BUCKET INSERT FOR CONTAINING TOOLS

BACKGROUND OF THE INVENTION

1. Field of the Invention

The present invention relates to tool containers and more particularly pertains to a new removable bucket insert for containing a plurality of tools within a bucket in an organized manner.

2. Description of the Prior Art

The use of tool containers is known in the prior art. More specifically, tool containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art tool containers include U. S. Pat. No. 4,952,026; U.S. Pat. No. 5,350,065; U.S. Pat. No. 5,092,463; U.S. Pat. No. 3,298,532; U.S. Pat. No. 1,914,276; and U.S. Pat. Des. 354,596.

In these respects, the removable bucket insert for containing tools according to the present invention substantially departs from the conventional concepts and designs of the prior art, and in so doing provides an apparatus primarily developed for the purpose of containing a plurality of tools within a bucket in an organized manner.

SUMMARY OF THE INVENTION

In view of the foregoing disadvantages inherent in the known types of tool containers now present in the prior art, the present invention provides a new removable bucket insert construction wherein the same can be utilized for containing a plurality of tools within a bucket in an organized manner.

The general purpose of the present invention, which will be described subsequently in greater detail, is to provide a new removable bucket insert for containing tools apparatus and method which has many of the advantages of the tool containers mentioned heretofore and many novel features that result in a new removable bucket insert for containing tools which is not anticipated, rendered obvious, suggested, or even implied by any of the prior art tool containers, either alone or in any combination thereof.

To attain this, the present invention generally comprises a bucket having a circular bottom face. A cylindrical side wall is integrally coupled to the bottom face and extends upwardly therefrom. for defining an interior space and an open top. In use, a lid may be removably situated over the open top of the bucket for scaling the same. The tool container insert of the present invention includes a bottom horizontal plate with a planar circular configuration, as shown in FIG. 2. A pair of planar rectangular upstanding plates are also included and each have a bottom edge fixedly coupled to a top surface of the bottom horizontal plate. Such bottom edges of the rectangular upstanding plates flank a central bisector of the bottom horizontal plate and further remain in parallel relationship therewith. As best shown in FIG. 2, the rectangular upstanding plates extend upwardly and outwardly to define a constant V-shaped vertical cross-section. The tool container insert further includes a pair of arcuate side walls each having a lower edge coupled to a periphery of the bottom horizontal plate. A pair of sides of each of the arcuate side walls are coupled to side edges of a corresponding one of the rectangular upstanding plates.

The arcuate side walls are equipped with a height equal to about ⅓ that of the rectangular upstanding plates. Further, the arcuate side walls define a pair of side compartments each with an open top face. As shown in FIGS. 2 & 3, a central compartment is also defined between the rectangular upstanding plates. Also included is a top horizontal plate with a planar circular configuration. A bottom surface of the top horizontal plate is fixedly coupled to top edges of the rectangular upstanding plates. A plurality of cut outs are formed in the top horizontal plate for receiving tools therethrough. By this structure, a top extent of each tool is constrained by the corresponding cut out and a bottom extent of each tool is situated within one of the compartments. For removably lifting the insert in and out of the interior space of the bucket, the top horizontal plate further includes a handle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new removable bucket insert for containing tools apparatus and method which has many of the advantages of the tool containers mentioned heretofore and many novel features that result in a new removable bucket insert for containing tools which is not anticipated, rendered obvious, suggested, or even implied by any of the prior art tool containers, either alone or in any combination thereof.

It is another object of the present invention to provide a new removable bucket insert for containing tools which may be easily and efficiently manufactured and marketed.

It is a further object of the present invention to provide a new removable bucket insert for containing tools which is of a durable and reliable construction.

An even further object of the present invention is to provide a new removable bucket insert for containing tools which is susceptible of a low cost of manufacture with regard to both materials and labor, and which accordingly is then susceptible of low prices of sale to the consuming public, thereby making such removable bucket insert for containing tools economically available to the buying public.

Still yet another object of the present invention is to provide a new removable bucket insert for containing tools which provides in the apparatuses and methods of the prior art some of the advantages thereof, while simultaneously overcoming some of the disadvantages normally associated therewith.

Still another object of the present invention is to provide a new removable bucket insert for containing a plurality of tools within a bucket in an organized manner.

Even still another object of the present invention is to provide a new removable bucket insert for containing tools which is removably situated within the bucket and further includes a handle for facilitating the removal thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
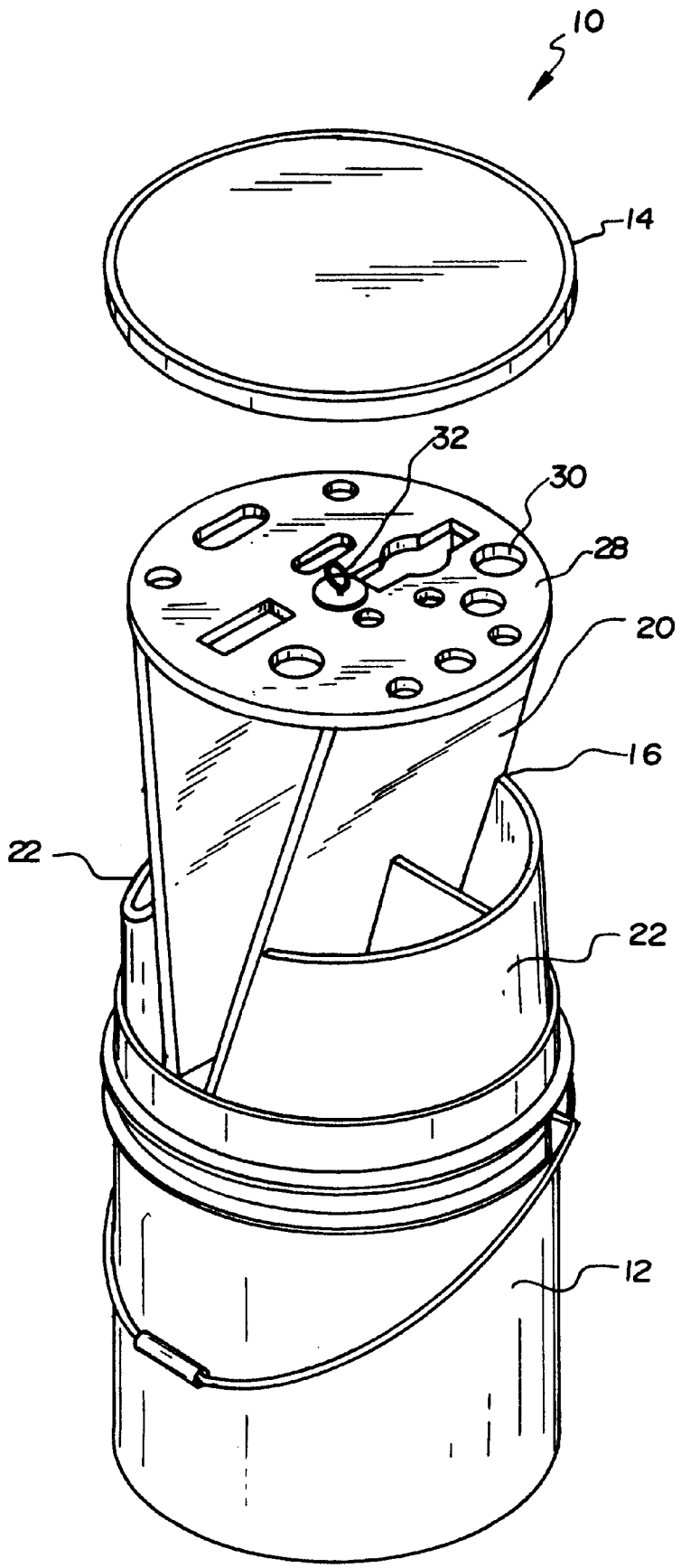
FIG. 1 is an exploded view of a new removable bucket insert for containing tools according to the present invention.
Figure 2:
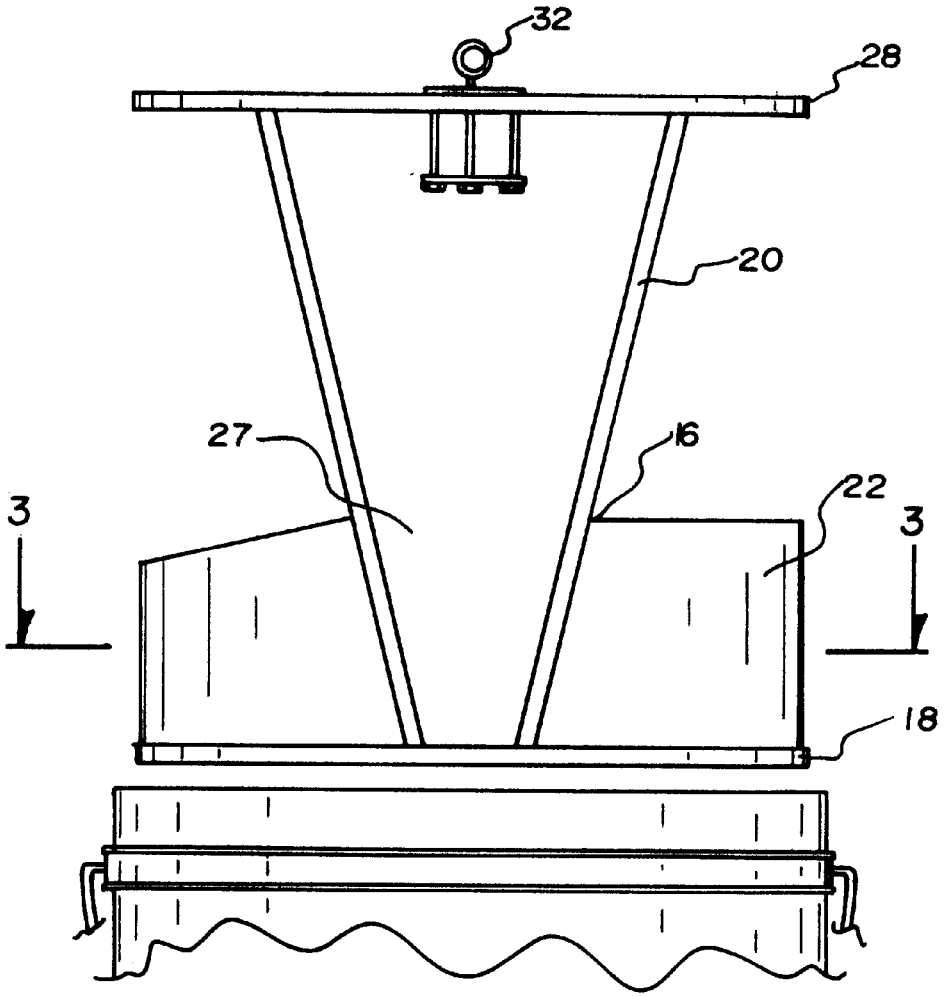
FIG. 2 is a side view of the present invention.
Figure 3:
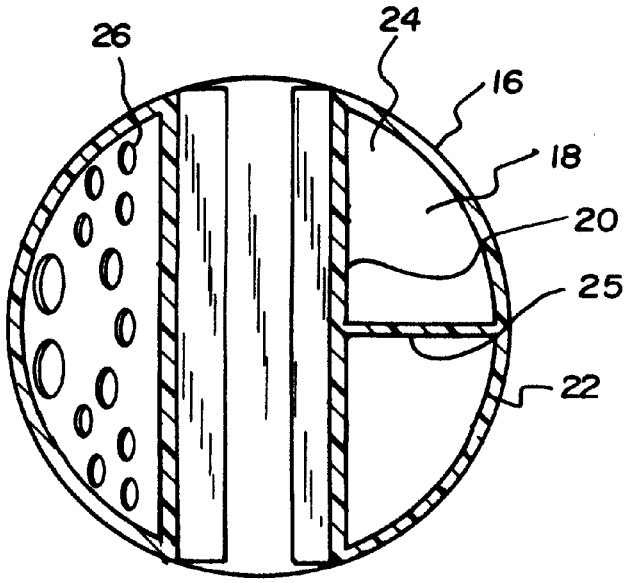
FIG. 3 is a top view of the present invention.

With reference now to the drawings, and in particular to FIGS. 1 through 3 thereof, a new removable bucket insert for containing tools embodying the principles and concepts of the present invention and generally designated by the reference numeral 10 will be described.

The present invention, designated as numeral 10, includes a bucket 12 having a circular bottom face. A cylindrical side wall is integrally coupled to the bottom face and extends upwardly therefrom for defining an interior space and an open top. In use, a lid 14 may be removably situated over the open top of the bucket for sealing the same.

The tool container insert 16 of the present invention includes a bottom horizontal plate 18 with a planar circular configuration, as shown in FIG. 2. A pair of planar rectangular upstanding plates 20 are also included and each have a bottom edge fixedly coupled to a top surface of the bottom horizontal plate. Such bottom edges of the rectangular upstanding plates flank a central bisector of the bottom horizontal plate and further remain in parallel relationship therewith. As best shown in FIG. 2, the rectangular upstanding plates extend upwardly and outwardly to define a constant V-shaped vertical cross-section.

The tool container insert further includes a pair of arcuate side walls 22 each having a lower edge coupled to a periphery of the bottom horizontal plate. A pair of sides of each of the arcuate side walls are coupled to side edges of a corresponding one of the rectangular upstanding plates. The arcuate side walls are equipped with a semi-cylindrical configuration and a height equal to about ⅓ that of the rectangular upstanding plates. Further, the arcuate side walls define a pair of side compartments 24 each with an open top face. Ideally, one of the side compartments has a central divider 25. A second one of the side compartments is equipped with a plurality of apertures 26 formed in a portion of the bottom horizontal plate which resides thereunder. Further, the second one of the side compartments is equipped with a beveled upper peripheral edge. As shown in FIGS. 2 & 3, a central compartment 27 is also defined between the rectangular upstanding plates.

Also included is a top horizontal plate 28 with a planar circular configuration. As shown in the Figures, the top horizontal plate has a diameter equal to that of the bottom horizontal plate and the bottom face of the bucket. A bottom surface of the top horizontal plate is fixedly coupled to top edges of the rectangular upstanding plates.

A plurality of cut outs 30 are formed in the top horizontal plate for receiving tools therethrough. In the preferred embodiment, at least one linear radially extending cut out is formed in the top horizontal plate. Further, a plurality of oval, rectangular and circular cut outs are formed in the top horizontal plate, as shown in FIG. 1, for accommodating different tools.

By this structure, a top extent of each tool is constrained by the corresponding cut out and a bottom extent of each tool is situated within one of the compartments. For removably lifting the insert in and out of the interior space of the bucket, the top horizontal plate further includes a handle 32. As shown in FIG. 2, the handle includes a top and bottom strip interconnected by way of a plurality of vertical members which are in turn slidably situated within bores formed in the top horizontal plate. A top one of the strips has an eyelet formed thereon for gripping purposes.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tool container insert for a bucket comprising, in combination:

a bucket having a circular bottom face and cylindrical side wall integrally coupled to the bottom face and extending upwardly therefrom for defining an interior space and an open top, wherein a lid may be removably situated over the open top of the bucket for sealing the same;

a bottom horizontal plate with a planar circular configuration;

a pair of planar rectangular upstanding plates each having a bottom edge fixedly coupled to a top surface of the bottom horizontal plate and flanking a central bisector thereof in parallel relationship therewith, wherein the upstanding plates extend upwardly and outwardly to define a constant V-shaped vertical cross-section;

a pair of arcuate side walls each having a lower edge coupled to a periphery of the bottom horizontal plate and a pair of sides coupled to side edges of a corresponding one of the rectangular upstanding plates, wherein the arcuate side walls have a height equal to about ⅓ that of the rectangular upstanding plates, thereby defining a pair of side compartments each with an open top face and a central compartment between the rectangular upstanding plates; and a top horizontal plate with a planar circular configuration having a bottom surface fixedly coupled to top edges of the rectangular upstanding plates, the top horizontal plate having a plurality of cut outs formed therein for receiving tools therethrough such that a top extent of each tool is constrained by the corresponding cut out and a bottom extent of each tool is situated within one of the compartments, the top horizontal plate further including a handle for removably lifting the insert in and out of the interior space of the bucket.

2. A tool container insert system for use with a bucket comprising:

a tool container insert for containing tools thereon, the tool container insert being removably situated within the bucket and further including a handle for facilitating the removal of the tool container insert and a pair of upstanding plates connecting a top plate and a bottom plate of the tool container insert, the upstanding plates forming a generally V-shaped vertical configuration, wherein the top plate and the bottom plate have a periphery of a similar size and shape and the upstanding plates converge toward the bottom plate.

3. A tool container insert for a bucket as set forth in claim 2 wherein the tool container insert includes a pair of diametrically opposed compartments formed on a bottom face of the tool container insert.

4. A tool container insert for a bucket as set forth in claim 2 wherein the handle is situated at a central extent of the tool container insert.

5. A tool container insert for a bucket as set forth in claim 2 wherein the tool container insert allows the securement of a lid on the bucket when situated within the bucket.

6. A tool container insert system adapted for use with a bucket comprising:

a tool container insert for containing tools thereon, the tool container insert being removably situated within the bucket and further including a handle for facilitating the removal of the tool container insert, wherein the tool container insert includes a pair of upstanding plates connecting a top plate and a bottom plate of the tool container insert;

wherein the handle is slidably positioned within at least one aperture formed in the top plate of the tool container insert; and wherein the tool container insert allows the securement of a lid on the bucket when the tool container is situated in the bucket.

7. A tool container insert for a bucket as set forth in claim 6 wherein the tool container insert includes a pair of diametrically opposed compartments formed on a bottom face of the tool container insert.

8. A tool container insert for a bucket as set forth in claim 6 wherein the upstanding plates have a generally V-shaped vertical cross-section.

9. A tool container insert for a bucket as set forth in claim 6 wherein the handle includes a top strip, a bottom strip, and at least one vertical member connected between the top strip and the bottom strip.

10. A tool container insert for a bucket as set forth in claim 9 wherein the top strip of the handle has an eyelet mounted thereon.

* * * * *